US005725638A

United States Patent [19]

Cross et al.

[11] Patent Number: 5,725,638

[45] Date of Patent: Mar. 10, 1998

[54] MODULAR ELECTROSTATIC PRECIPITATION DUST COLLECTION PLATE ASSEMBLY

[75] Inventors: Steven R. Cross, East Berlin, Pa.; Stuart J. Pass, Owings Mills, Md.

[73] Assignee: Environmental Elements Corp., Baltimore, Md.

[21] Appl. No.: 754,706

[22] Filed: Nov. 21, 1996

[51] Int. Cl.[6] ..... B03C 3/47

[52] U.S. Cl. ..... 96/71; 24/563; 96/86; 96/87; 96/100

[58] Field of Search ..... 96/98, 100, 84, 96/86, 87, 65, 71, 68, 70; 95/78; 24/563

[56] References Cited

U.S. PATENT DOCUMENTS

| | | | |
|---|---|---|---|
| 2,213,234 | 9/1940 | Tinnerman | 403/42 |
| 2,575,181 | 11/1951 | Mack | 52/581 |
| 3,023,468 | 3/1962 | Hord et al. | 164/138 |
| 3,236,017 | 2/1966 | Doering | 52/579 |
| 3,402,526 | 9/1968 | Baxter | 96/100 |
| 3,418,792 | 12/1968 | Quintilian et al. | 52/522 X |
| 3,512,805 | 5/1970 | Glatz | 285/109 |
| 3,970,351 | 7/1976 | Hollingsead et al. | 439/295 |
| 3,994,111 | 11/1976 | Papayoti | 52/650.3 |
| 4,203,646 | 5/1980 | Desso et al. | 439/724 |
| 4,239,514 | 12/1980 | Junkers | 96/87 |
| 4,240,810 | 12/1980 | Fravenfelder | 96/86 |
| 4,559,064 | 12/1985 | Ahern | 96/87 |
| 4,738,007 | 4/1988 | Demarest, Jr. | 24/67.9 |
| 4,745,666 | 5/1988 | Murphy | 24/453 |
| 4,759,779 | 7/1988 | Shedd | 96/87 |
| 4,869,736 | 9/1989 | Ivester et al. | 96/100 |
| 5,174,371 | 12/1992 | Grillo | 165/171 |
| 5,355,646 | 10/1994 | Bischel et al. | 24/563 X |
| 5,366,540 | 11/1994 | Bojsen | 96/87 X |
| 5,388,284 | 2/1995 | Garnett | 24/563 X |
| 5,409,198 | 4/1995 | Roick | 24/563 X |

*Primary Examiner*—Richard L. Chiesa

*Attorney, Agent, or Firm*—Morton J. Rosenberg; David I. Klein; Jun Y. Lee

[57] ABSTRACT

A modular dust collection plate assembly (10) for use in an electrostatic precipitator is provided. The dust collection plate assembly (10) includes at least one panel member (100) and at least one waveform member (200) releasably coupled together. The panel member (100) is characterized by a substantially planar contour, having first and second faces on opposing sides thereof which are commonly bounded laterally by a pair of lateral edge portions (110, 110) extending in a longitudinal direction. The waveform member (200) also extends in the longitudinal direction and is characterized by a predetermined curvilinear cross-sectional contour that enables the waveform member (200) to disrupt at least a portion of the gaseous flow that would pass across it during operation in an electrostatic precipitator. The waveform member (200) terminates at each of its laterally-opposed sides in a flange portion (212) which has formed thereon a joint mechanism for forming a substantially continuous joint with one of the panel member's lateral edge portions (110). In a preferred embodiment of the dust collection plate assembly (10), the panel member (100) adjacent its lateral edge portions includes a plurality of upsets (120) which protrude from one of the panel member's first and second faces. Each joint mechanism of the waveform member (200) includes a clip section which receives therein a lateral edge portion (110) of the panel member (100) and lockingly engages the upsets (120) formed on the panel member (100) adjacent that lateral edge portion (110).

20 Claims, 5 Drawing Sheets

MODULAR ELECTROSTATIC PRECIPITATION DUST COLLECTION PLATE ASSEMBLY

BACKGROUND OF THE INVENTION

1. Field of the Invention

The subject modular electrostatic precipitation dust collection plate assembly is generally directed to a dust collection electrode plate assembly for use in electrostatic precipitators. More specifically, the subject dust collection plate assembly is a modular assembly for collecting particulates suspended within a gaseous flow generated in an electrostatic precipitator which may be readily assembled and disassembled in order that its component members may be flexibly configured in arrangement such that it may adapt to various installation requirements and may be efficiently packed for shipping.

Dust collecting electrode plates are employed in electrostatic precipitators to electrostatically attract and collect thereon particulates suspended within a gaseous flow generated by the precipitator. Generally, a plurality of such dust collecting electrode plates are secured in a precipitator to form a number of parallel assemblies which define therebetween a plurality of parallel air flow passages through which the gaseous flow generated within a precipitator passes. Each plate is electrically charged of a potential different from that of the particulates within the gaseous flow such that as the gaseous flow passes in a given passage, the charged particulates within the gaseous flow are attracted to and collect on the plates defining the given air flow passage. The particulates, or dust, collected on each electrode plate are subsequently discharged into a hopper for subsequent removal by vibrating, or otherwise mechanically disturbing the electrode plate.

A dust collecting electrode plate is generally formed with a plurality of planar components separated by undulating waveforms projecting from the opposing faces thereof at predetermined intervals. These waveforms typically extend the vertical length of the dust collecting electrode plate, each waveform serving to disrupt the gaseous flow in a predetermined manner. The waveforms of adjacent electrode plates are mutually aligned such that the lateral boundaries of the air flow passage defined between adjacent electrode plates follows the curvature of the plates' waveforms without any substantial constriction in the air flow passage arising therefrom. The gaseous flow travelling through a given air flow passage, therefore, experiences at each waveform, an abrupt acceleration followed by an abrupt deceleration. This creates a low velocity, or quiescent, zone which enhances the settling of particulates within the traversing gaseous flow onto a proximate electrode plate surface.

As shown in FIG. 1, such air flow-disrupting waveforms 3 are invariably formed onto the electrode plates 2 of a prior art electrostatic precipitator 1 so as to exploit this phenomenon. The number of such waveforms 3, and the relative displacements between successive waveforms 3, 3 on a given electrode plate 2, varies depending on the particular application or configuration of the given electrostatic precipitator 1. Typically, the construction of the electrostatic precipitator 1 is such that the number and spacing of waveforms 3 appearing on a common electrode plate remain fixed entities. Often, discharge electrode structures such as the collar- or pin-like discharge electrodes 6 are affixed to the electrostatic precipitator and thereby positioned to extend through the air flow passages 5 defined between adjacent electrode plates 2, 2 at suitable positions relative to the waveforms 3 of those plates.

2. Prior Art

Dust collection electrode plate assemblies for use in electrostatic precipitators having both waveform and planar components are known in the art. The best prior art known to Applicant includes U.S. Pat. Nos. 3,418,792; 2,575,181; 4,203,646; 5,174,371; 3,023,468; 3,970,351; 3,402,526; 5,355,646; 5,388,284; 2,213,234; 5,409,198; 3,512,805; 4,738,007; 3,236,017; 3,994,111; and, 4,745,666. While this prior art, for instance in U.S. Pat. No. 3,418,792, discloses multi-part electrode plate assemblies; it does not disclose electrostatic precipitation dust collection plate assemblies providing the nature and degree of modularity provided by the dust collection plate assembly of the present invention.

The waveform and planar components of prior art electrode plate assemblies are formed integrally as a single unit. This prevents separation of the waveform component from its adjacent planar component, despite the fact that it impedes air flow and is thereby subjected to a force in a direction parallel to the plane of the given electrode plate. The integral formation of the waveform and planar components in a common structure, however, presents significant practical drawbacks. First, such a structure does not afford much flexibility in the configuration of an electrode plate assembly formed by combining a plurality thereof. Thus, any customization in the field to, for instance, adapt to variances or structural/dimensional peculiarities of a particular electrostatic precipitator, or to selectively vary the spacing between waveforms along an electrode plate assembly would not be possible without either remanufacturing the electrode plate or taking extensive modification measures.

The practical significance of this drawback becomes even clearer when one considers that different manufacturers of electrostatic precipitators in past years have employed in their respective precipitator designs electrode plates incorporating a wide range of waveform shapes, sizes, and spacing widths. Cost-saving retrofit efforts to preserve or upgrade the operability of existing electrostatic precipitators, particularly those of an older design, are thus rendered quite impractical by the lack of modularity in prior art electrode plate components. Moreover, in those cases where modifications are made to an existing electrostatic precipitator to alter the separation distance between opposed electrode plate assemblies, it becomes desirable to also alter accordingly the spacing between adjacent waveform components of each electrode plate assembly, for only then can full realization of the dust collection-enhancing effects of the air flow disruptions caused by those waveform components be preserved. Such altering of waveform spacing widths is not possible with the present lack of electrode plate component modularity.

Another drawback to this lack of modularity is that even a nominally expansive electrode plate assembly may not be assembled within the tight dimensional confines of an electrostatic precipitator, except possibly with great difficulty. The irregular shape of an electrode plate segment having both waveform and planar components renders manipulation of the plate segment within those tight dimensional confines quite cumbersome and awkward.

Finally, another drawback of practical significance is evident when the packing of electrode plate segments for their shipping is considered. Although prior art electrode plate segments are designed to stack essentially in flush contact with one another, and may thereby be nested; the integral formation of waveform and planar sections necessarily hinders efficient packing of electrode plate segments, at least when the stacked segments are packed, as they typically are, within crates or boxes of generally rectangular configuration. The wasted packing space that invariably results immediately above and/or below the planar sections of a given stack of electrode plate segments within a packing crate due to the projection of the stack's waveform components prevents full consumption of the given crate's volumetric capacity from being even marginally approached. Thus, unless the stacked waveform sections are significantly deformed or otherwise flattened; or, unless the electrode segments are packed in 'unnested' manner (which may allow damage to occur during shipping); efficient packing cannot be realized.

SUMMARY OF THE INVENTION

A primary object of the present invention is to provide a modular electrostatic precipitation dust collection plate assembly which may be conveniently assembled or disassembled.

Another object of the present invention is to provide a modular electrostatic precipitation dust collection plate assembly which may be readily assembled without the aid of any specially designed or dedicated tools.

It is another object of the present invention to provide a modular electrostatic precipitation dust collection plate assembly which may be readily assembled in the field.

It is another object of the present invention to provide a modular electrostatic precipitation dust collection plate assembly having at least one modular waveform component and at least one modular planar component.

It is another object of the present invention to provide a modular electrostatic precipitation dust collection plate assembly wherein the spacing between successive waveform components may be readily modified.

It is another object of the present invention to provide a modular electrostatic precipitation dust collection plate assembly which enables optimally efficient packing thereof for shipment.

It is yet another object of the present invention to provide a modular electrostatic precipitation dust collection plate assembly having modular components which may be stacked for packing within a rectangular shipping box or crate in such manner that both the volumetric and weight capacities of the given shipping box or crate are substantially consumed.

These and other objects are attained by the modular electrostatic precipitation dust collection plate assembly of the present invention. The subject plate assembly generally includes at least one panel member and at least one waveform member releasably coupled thereto. The panel member is characterized by a substantially planar contour defined by first and second faces on opposing sides thereof which are commonly bounded laterally by a pair of lateral edge portions extending along a longitudinal direction. The waveform member also extends in the longitudinal direction and is characterized by a predetermined curvilinear cross-sectional contour which enables the waveform member to impede in a predetermined manner at least a portion of a gaseous flow passing transversely thereacross. The waveform member terminates at each laterally opposed side thereof in a laterally-projecting flange portion which has formed thereon a joint mechanism for forming a substantially continuous joint with one of the panel member's lateral edge portions.

In a preferred embodiment of the present invention, the joint mechanism formed on each flange portion of the waveform member includes a clip section extending longitudinally along the given flange portion. The clip section is formed by a pair of clip extensions which define therebetween a longitudinally-extending slot for securely receiving a lateral edge portion of the panel member therein. At least one of the clip extensions of each clip section has formed thereon a lock mechanism for lockingly engaging a portion of the panel member. Preferably, that stop mechanism is in the form of a stop surface that extends transversely into the slot chamber.

Also in a preferred embodiment of the present invention, at least one of the first and second faces of the panel member has formed thereon adjacent at least one of its lateral edge portions a plurality of protruding upsets. Each upset is configured to engage the stop surface within a clip section of a waveform member flange portion when the portion of the panel member on which it is formed is inserted within the clip section. The engagement of the upsets with the slotted section stop surface prevents the lateral decoupling of the given panel member from the given waveform member.

DETAILED DESCRIPTION OF THE PREFERRED EMBODIMENTS

Figure 1:
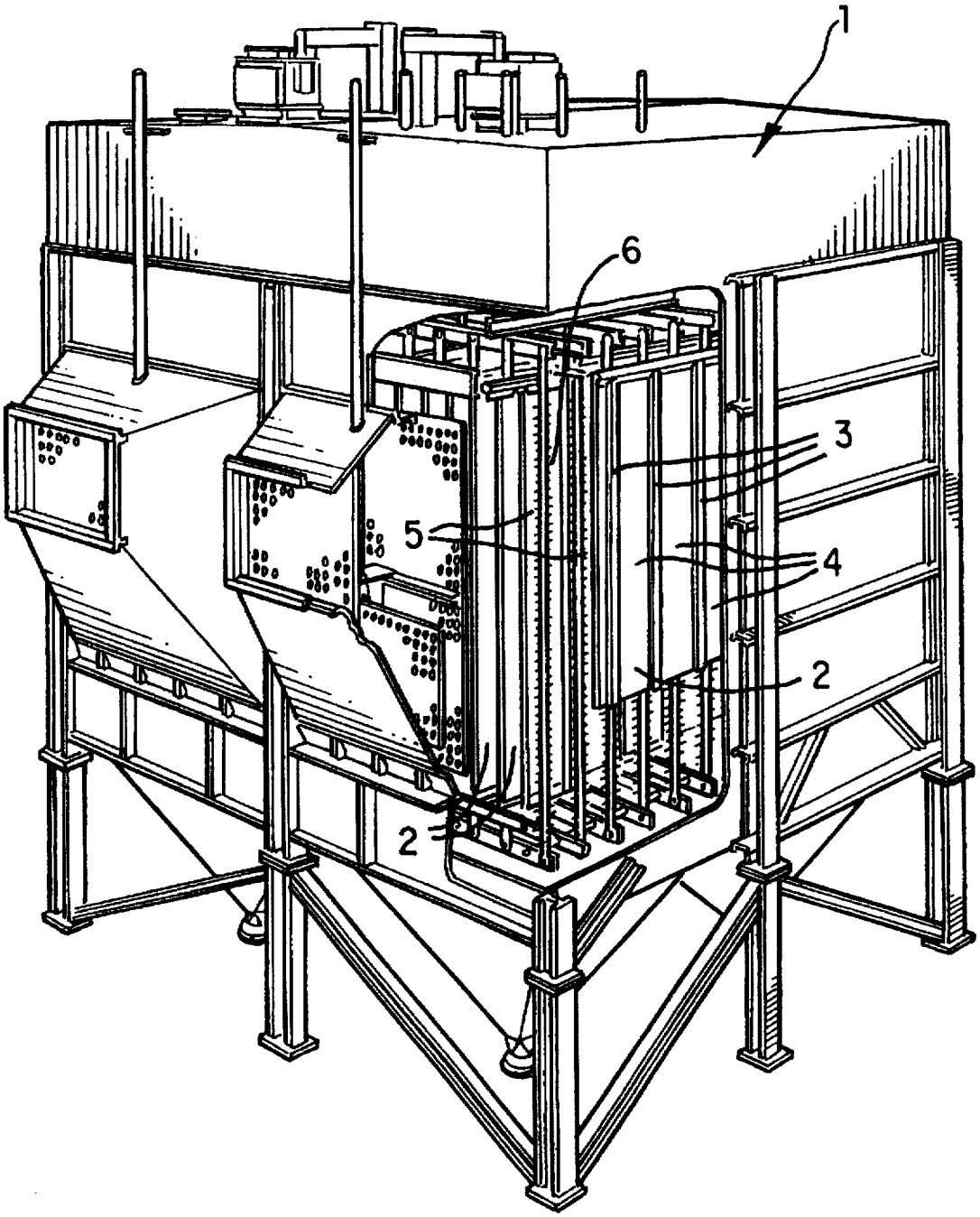
FIG. 1 PRIOR ART
FIG. 1 is a perspective view of a prior art electrostatic precipitator partially cut-away to reveal the electrode plate dust collection mechanisms employed therein.
Figure 2:
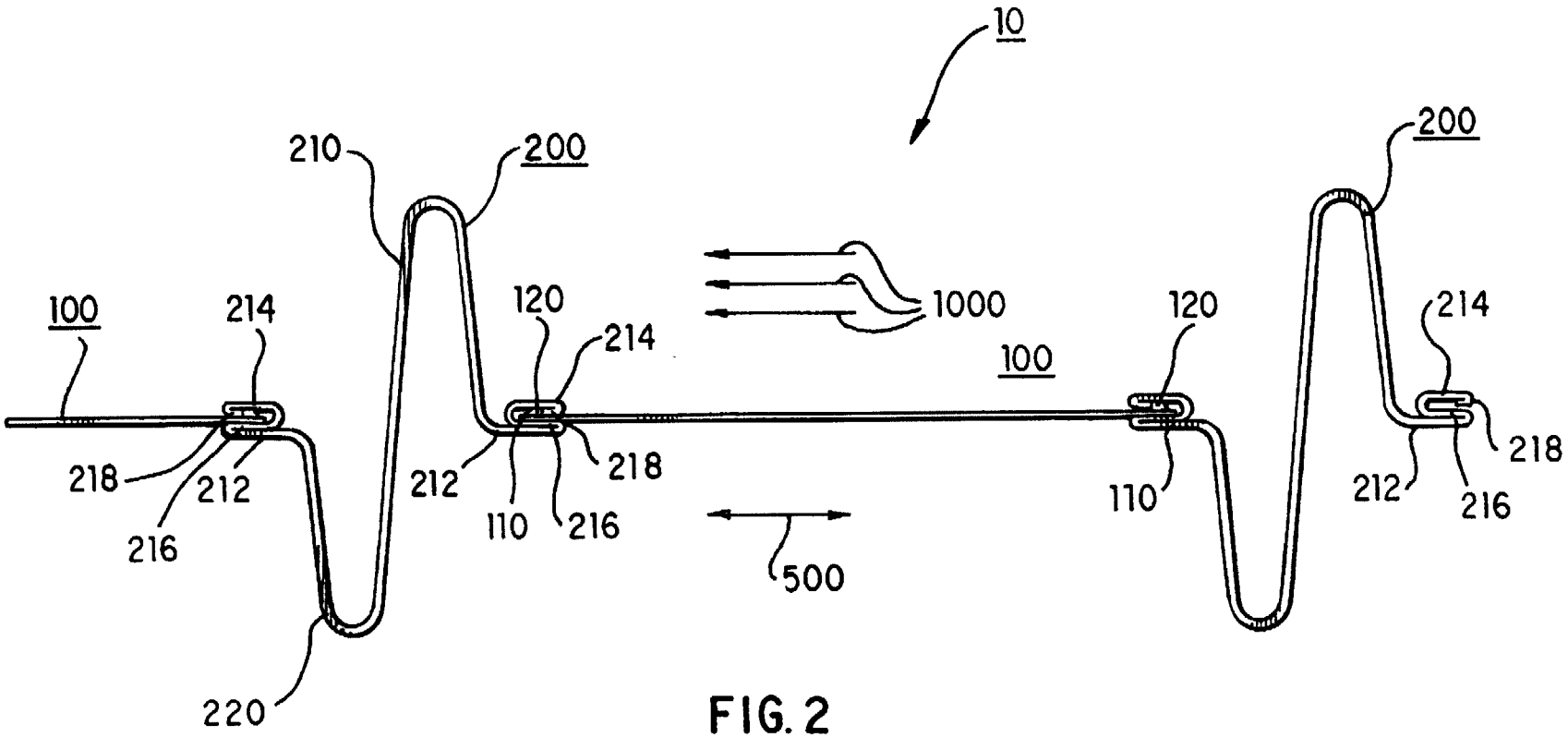
FIG. 2 is a sectional view of a preferred embodiment of the modular electrostatic precipitation dust collection plate assembly of the present invention.
Figure 3:
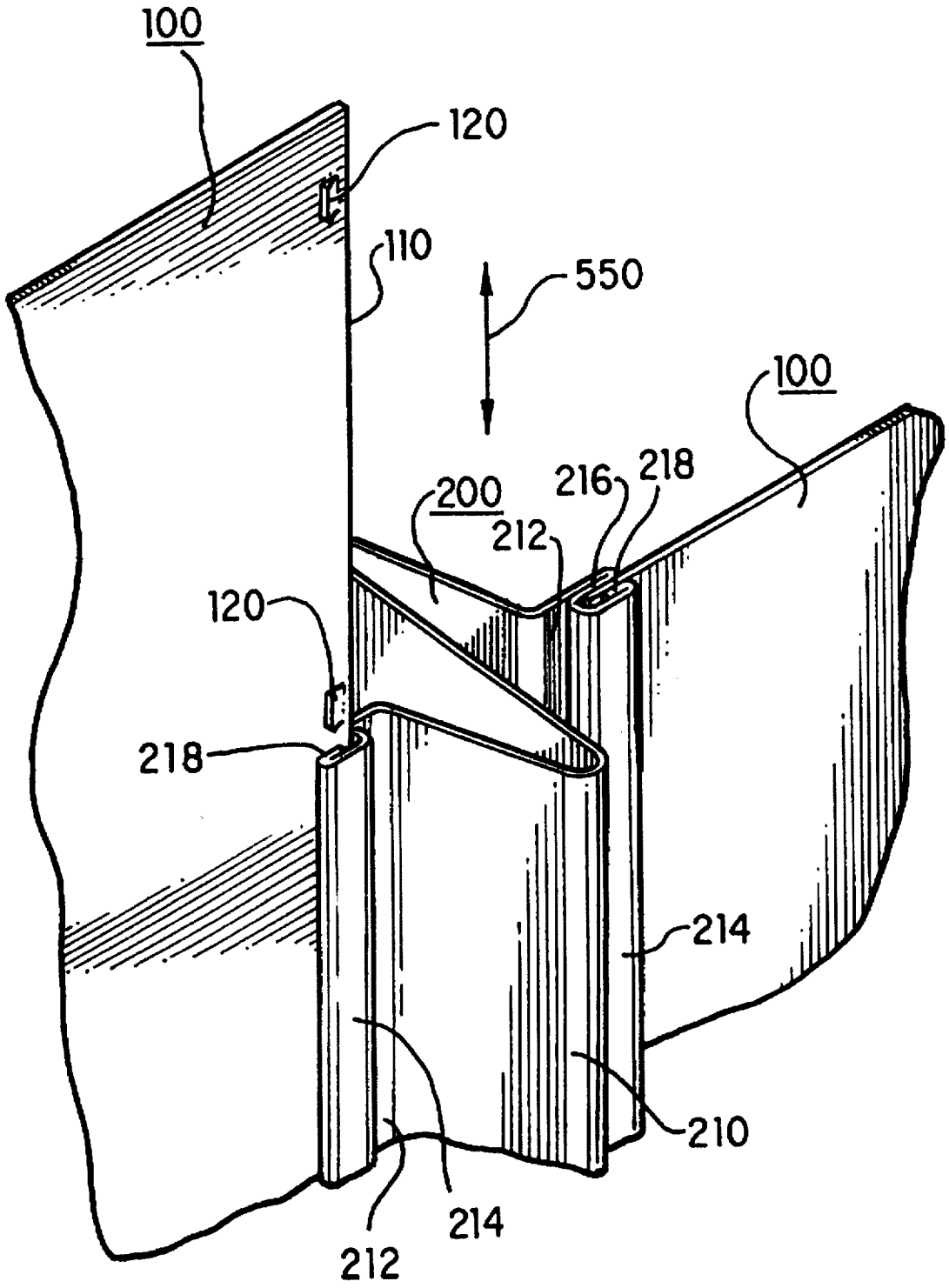
FIG. 3 is a detailed perspective view, partially cut-away, of the preferred embodiment of the subject modular electrostatic precipitation dust collection plate assembly embodiment shown in FIG. 2, illustrating the engagement of a panel member with a waveform member.

Referring now to FIGS. 2 and 3, there are shown sectional and perspective views of a preferred embodiment of the modular electrostatic precipitation dust collection plate assembly 10 of the present invention. Dust collection plate assembly 10 includes a planar panel member 100 and at least one waveform member 200. Preferably, more than one each of planar members 100 and waveform members 200 are successively coupled as shown to laterally extend the resulting plate assembly 10 as required by a given application.

Each of the panel and waveform members 100, 200 is preferably formed of a metallic composition of suitable strength, rigidity, and electrical conductivity to enable the resulting plate assembly 10 to serve as a dust-collecting electrode plate within an electrostatic precipitator. For most applications, an 18 GA steel is a suitable material, although other materials exhibiting properties similar to that exhibited by such material may be employed. The material employed may be galvanized, or otherwise treated, to resist corrosion and other forms of deterioration that may result from the harsh operational environment typically found within an electrostatic precipitator.

Each panel member 100 extends both in a lateral direction, as indicated by directional arrows 500, and in a longitudinal direction, as indicated by directional arrows 550. Each panel member 100 is laterally bounded by a pair of lateral edge portions 110, 110. Formed on one of the planar faces of panel member 100 at laterally peripheral portions thereof are a plurality of protruding upsets 120. These upsets 120 are preferably formed simply as disturbances in the panel member 100 which protrude sufficiently from the given surface of that panel member 100 to engage a stop surface formed, as described in following paragraphs, within a joint mechanism of a waveform member 200 to form with that joint mechanism a Pittsburgh joint, as it is known in the art. The resulting joint allows slidable displacement in the longitudinal direction relative to a waveform member 200 to which it is coupled but opposes decoupling in the lateral direction. The protruding upsets 120 along a lateral edge of the given panel member 100 contact the stop surface formed in the joint mechanism of the given waveform member 200 such that further lateral displacement of the panel member 100 away from the waveform member 200 is blocked.

Each waveform member 200 preferably extends longitudinally a length substantially equal to the longitudinal extent of each panel member 100 to which it is coupled. In addition to reinforcing the planar rigidity of the resulting dust collection plate assembly 10, waveform member 200 serves to enhance the dust collecting function of that assembly 10. Each waveform member 200 is characterized by an undulating cross-sectional contour which defines on that waveform member 200 a pair of longitudinally-extending baffle portions 210, 220 which project outwardly, in generally opposing directions. The baffle portions 210, 220 are contoured in predetermined manner so as to disrupt the air flow, indicated by directional arrows 1000, that would be generated within an electrostatic precipitator laterally thereacross during the precipitator's operation. The sectional contour of the baffle portions 210, 220 shown in FIG. 2 is known in the prior art to be quite effective in causing the generation of a quiescent zone which promotes the collection of particulates suspended within the passing air flow to be collected on the surfaces of plate assembly 10. The particular choice of a cross-sectional contour for baffle portions 210, 220, however, is not important to the present invention.

Each baffle portion 210, 220 of a waveform member 200 respectively terminates in flanges 212, 212. Each flange 212, 212 has formed thereon a mechanism for forming a Pittsburgh joint with a laterally peripheral portion of a panel member 100. More specifically, the terminal portion of each flange 212 is bent as shown to integrally form a longitudinally-extending clip section. The bent flange portion forming this clip section terminates in an abutment 218 which defines a stop surface against which the upsets 120 of that lateral portion of panel member 100 inserted into the clip section are brought to bear when a lateral force away from this coupling section is imparted on the panel member 100.

The clip section includes upper and lower clip extensions 214, 216 which define therebetween a longitudinal slot. This slot is of sufficient dimension and contour to receive a lateral edge 110 of a panel member 100, as well as the plurality of upsets 120 formed on the panel member 100 adjacent the given lateral edge 110. The coupling may be effected either by sliding longitudinally one of the panel or waveform members 100, 200 relative to the other, or by forcibly snapping the given lateral peripheral portion of the panel member 100 into the given clip section of the waveform member 200. Once coupled, a Pittsburgh joint is formed, and the abutting engagement of the upsets 120 and abutment 218 prevents the unintended lateral release of the panel member 100 from the waveform member 200.

Figure 4:
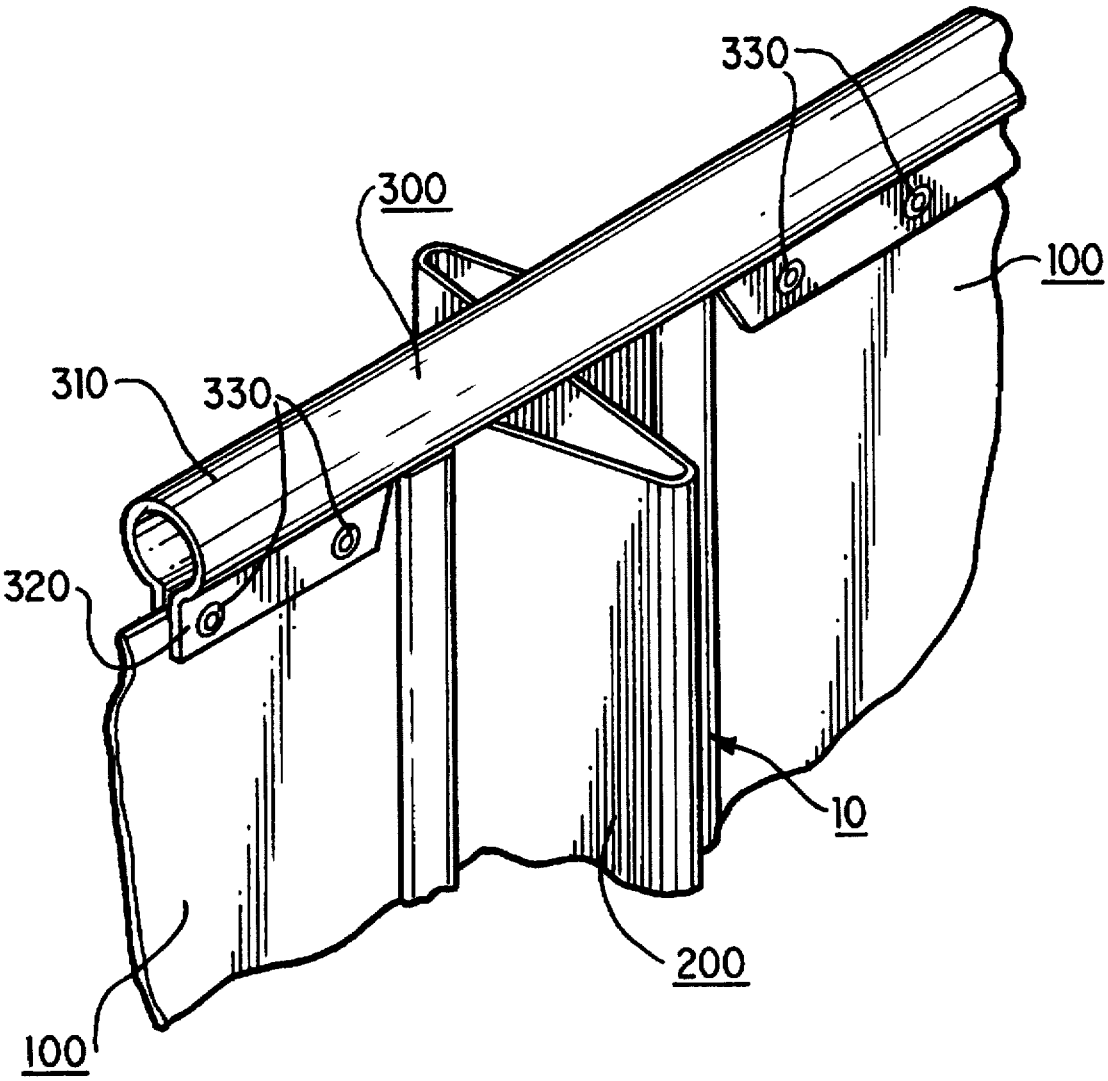
FIG. 4 is a perspective view, partially cut-away, of the preferred embodiment of the subject modular electrostatic precipitation dust collection plate assembly shown in FIG. 2, illustrating the mechanism by which it is fastened for suspension within an electrostatic precipitator; and, FIG. 5 is a perspective view, partially cut-away, of a plurality of dust collection plates formed by assembling a plurality of the modular electrostatic precipitation dust collection plate assemblies of FIG. 2 mounted within an electrostatic precipitator.

Referring now to FIGS. 4, there is shown a mechanism by which the subject plate assembly 10 may be secured within an electrostatic precipitator. More specifically, there is shown a tadpole member 300 having a tubular section 310 and a pair of fastening plates 320 extending therefrom. A plate assembly 10 may be suspended for operation within an electrostatic precipitator by inserting the longitudinal edges of its panel members 100 between the fastening plates 320, 320, and inserting a plurality of suitable fastening mechanisms 330 such as rivets, retaining pins, or the like. In the alternative, more permanent means, such as welding, may be employed to secure the longitudinal peripheral portions of panel members 100 within the fastening plates 320, 320.

Figure 5:
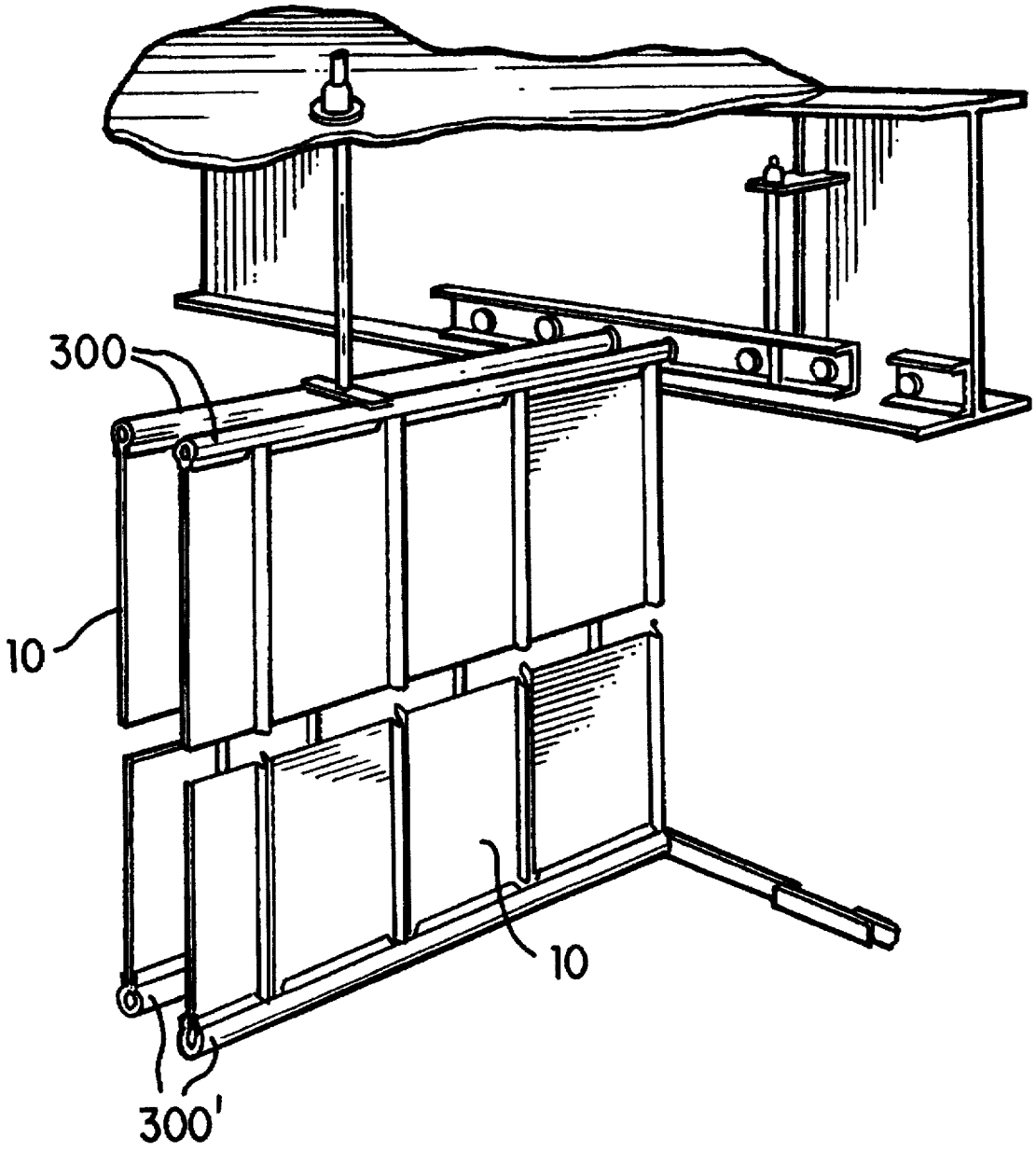

Preferably, lower and upper tadpole members 300, 300' are provided, as shown in FIG. 5, to secure the panel members 100 of each plate assembly 10 both at its upper and lower peripheral portions. This reinforcement adds an added measure of stability to insure that the plate assemblies 10 will withstand the pressures due to the highest air flow velocities generated within the precipitator, as well as the severest of vibrations effected during dust-release plate shaking procedures. The tadpole members 300, 300' are, in turn, firmly secured to suitable mounting structures within the given electrostatic precipitator.

The convenient assembly and disassembly afforded by the resulting plate assembly 10 provides a degree of flexibility heretofore unseen in the art in the configuring of a dust collection electrode plate to suit a particular application. Not only does the simplicity of forming a substantially continuous yet secure joint between adjacent modular members 100, 200 enable the assembly/disassembly of the plate assembly 10 in the field, without the aid of any special tools or cumbersome manipulations; the separability of the waveform components from the planar components enables the spacing between adjacent waveform components in a given plate assembly to be readily varied. This may be accomplished by replacing the panel members 100 extending between pairs of waveform members 200, 200 with others of a different lateral dimension. Conversely, the waveform configuration employed in a given electrode plate assembly may be readily altered simply by replacing the existing waveform members 200 extending between pairs of panel members 100, 100 with others of a different configuration.

The detachability of the subject plate assembly's waveform member 200 from its panel member 100 also enables great benefits to be realized in the packing of numerous such assemblies for shipment. As clearly evident from the sectional view of FIG. 2, a plurality of waveform members 200 may be arranged in neatly nested stacks. A plurality of panel members 100, with its upsets 120 (each of which defines an indent in the panel member surface opposing that from which it protrudes), may likewise be arranged in neatly nested stacks. The nesting in this case would result from each upset 120 fitting within the surface indent defined beneath the corresponding upset 120 of the immediately overlaying panel member 100 in the stack. The stacks of waveform members 200 and panel members 100 may then be packed in a shipping crate, in such manner that substantially all of the available volume within that crate is occupied.

Although this invention has been described in connection with specific forms and embodiments thereof, it will be appreciated that various modifications other than those discussed above may be resorted to without departing from the spirit or the scope of the invention. For example, equivalent elements may be substituted for those specifically shown and described and certain features may bother independently of other features, all without departing from the spirit or scope of the invention as defined by the appended Claims.

What is claimed is:

1. A modular dust collection plate system for collecting particulates suspended within a gaseous flow in an electrostatic precipitator comprising:

(a) at least one substantially planar panel member having opposing first and second faces and a pair of lateral edge portions, said first and second faces extending between said lateral edge portions said lateral edge portions extending in a longitudinal direction; and, (b) at least one waveform member releasably coupled to said panel member for disrupting said gaseous flow in said electrostatic precipitator, said waveform member extending in said longitudinal direction and having a predetermined curvilinear cross-sectional contour adapted for impeding at least a portion of said gaseous flow passing transversely thereacross, said waveform member terminating respectively at laterally-opposed sides thereof in laterally-projecting flange portions, each of said flange portions having formed thereon joint means for forming a substantially continuous joint with one of said lateral edge portions of said panel member.

2. The modular dust collection plate system as recited in claim 1 wherein said joint means includes a clip section extending longitudinally along said flange portion, said clip section having a pair of clip extensions defining therebetween a longitudinally-extending slot for securely receiving said lateral edge portion of said panel member therein.

3. The modular dust collection plate system as recited in claim 2 wherein at least one of said clip extensions of each said clip section has formed thereon lock means for lockingly engaging a portion of said panel member.

4. The modular dust collection plate system as recited in claim 3 wherein said lock means includes a stop surface extending transversely into said slot from at least one of said clip extensions for opposing the lateral displacement of said panel member from said waveform member.

5. The modular dust collection plate system as recited in claim 4 wherein said panel member has formed adjacent at least one of said lateral edge portions a plurality of upsets, each of said upsets protruding from at least one of said first and second faces of said panel member and being adapted to engage said stop surface of said flange portion clip section of said waveform member.

6. The modular dust collection plate system as recited in claim 2 wherein said clip section is integrally formed on each said waveform member flange portion by bending at least a part thereof.

7. The modular dust collection plate system as recited in claim 1 wherein said waveform member forms a Pittsburgh joint with said panel member.

8. The modular dust collection plate system as recited in claim 1 wherein said predetermined cross-sectional contour of said waveform member is characterized by an undulating cross-sectional contour, said undulating cross-sectional contour defining at least a pair of baffle portions.

9. The modular dust collection plate system as recited in claim 2 wherein each said flange portion of said waveform member projects therefrom substantially laterally outward.

10. A modular dust collection plate system for collecting particulates suspended within a gaseous flow in an electrostatic precipitator comprising:

(a) at least one panel member having a substantially planar contour defined by first and second faces on opposing sides thereof, said first and second faces being commonly bounded laterally by a pair of lateral edge portions extending in a longitudinal direction; and, (b) at least one waveform member for disrupting said gaseous flow releasably coupled to said panel member, said waveform member extending in said longitudinal direction and being characterized by an undulating cross-sectional contour, said undulating cross-sectional contour defining in said waveform member at least a pair of baffle portions for impeding a portion of said gaseous flow in a predetermined manner when said gaseous flow passes thereacross in a direction substantially normal to said longitudinal direction, each of said baffle portions terminating in a flange portion projecting laterally therefrom, each said flange portion being adapted to form a substantially continuous joint with one of said lateral edge portions of said panel member.

11. The modular dust collection plate system as recited in claim 10 wherein each said flange portion of said waveform member includes a clip section, said clip section having a pair of clip extensions defining therebetween a longitudinally-extending slot for securely receiving said lateral edge portion of said panel member therein.

12. The modular dust collection plate system as recited in claim 11 wherein at least one of said clip extensions of each said clip section has formed thereon lock means for lockingly engaging a portion of said panel member.

13. The modular dust collection plate system as recited in claim 12 wherein said lock means includes a stop surface extending transversely into said slot from at least one of said clip extensions.

14. The modular dust collection plate system as recited in claim 13 wherein said panel member has formed adjacent at least one of said lateral edge portions a plurality of upsets, each of said upsets protruding from at least one of said first and second faces of said panel member and being adapted to engage said stop surface of said clip section.

15. The modular dust collection plate system as recited in claim 11 wherein said clip section is integrally formed on each said waveform member flange portion by bending at least a part thereof.

16. A modular dust collection plate system for collecting particulates suspended within a gaseous flow in an electrostatic precipitator comprising:

(a) at least one panel member having a substantially planar contour releasably coupled to a waveform member, said panel member having substantially parallel first and second peripheral portions extending in a longitudinal direction; and, (b) at least one said waveform member for disrupting said gaseous flow releasably coupled to said panel member, said waveform member extending in said longitudinal direction and being characterized by an undulating cross-sectional contour, said undulating cross-sectional contour defining in said waveform member at least a pair of baffle portions for impeding a portion of said gaseous flow in a predetermined manner when said gaseous flow passes thereacross in a direction substantially normal to said longitudinal direction, each of said baffle portions terminating in a flange portion projecting laterally therefrom, each said flange portion having formed thereon a longitudinally extending clip section adapted to matingly engage one of said peripheral portions of said panel member.

17. The modular dust collection plate system as recited in claim 16 wherein said clip section includes a pair of clip extensions defining therebetween a longitudinally-extending slot for securely receiving said peripheral portion of said panel member therein.

18. The modular dust collection plate system as recited in claim 17 wherein at least one of said clip extensions of each said clip section has formed thereon lock means for lockingly engaging a portion of said panel member.

19. The modular dust collection plate system as recited in claim 18 wherein said lock means includes a stop surface extending transversely into said slot from at least one of said clip extensions.

20. The modular dust collection plate system as recited in claim 19 wherein each of said first and second peripheral portions of said panel member has formed thereon a plurality of upsets protruding in a direction substantially normal to the plane of said panel member, each said upset being adapted to engage said stop surface of said clip section, whereby the lateral decoupling of said panel member from said waveform member is obstructed.

* * * * *